US007604055B2

(12) United States Patent
Richard et al.

(10) Patent No.: US 7,604,055 B2
(45) Date of Patent: Oct. 20, 2009

(54) COMPLETION METHOD WITH TELESCOPING PERFORATION AND FRACTURING TOOL

(75) Inventors: Bennett M. Richard, Kingwood, TX (US); Richard W. Xu, Houston, TX (US); Michael E. Wiley, Houston, TX (US)

(73) Assignee: Baker Hughes Incorporated, Houston, TX (US)

( * ) Notice: Subject to any disclaimer, the term of this patent is extended or adjusted under 35 U.S.C. 154(b) by 68 days.

(21) Appl. No.: 11/578,023

(22) PCT Filed: Apr. 8, 2005

(86) PCT No.: PCT/US2005/011869

§ 371 (c)(1),
(2), (4) Date: Jun. 12, 2007

(87) PCT Pub. No.: WO2005/100743

PCT Pub. Date: Oct. 27, 2005

(65) Prior Publication Data

US 2008/0035349 A1 Feb. 14, 2008

(51) Int. Cl.
*E21B 43/26* (2006.01)
*E21B 34/14* (2006.01)

(52) U.S. Cl. ..... 166/308.01; 166/332.4

(58) Field of Classification Search ..... 166/177.5, 166/205, 223, 222, 50, 227, 332.4
See application file for complete search history.

(56) References Cited

U.S. PATENT DOCUMENTS 2,391,609 A 12/1945 Wright
2,540,123 A 2/1951 Kinley
2,707,997 A 5/1955 Zandmer et al.
2,775,304 A 12/1956 Zandmer
2,855,049 A 10/1958 Zandmer
3,326,291 A 6/1967 Zandmer
3,347,317 A 10/1967 Zandmer
3,358,770 A 12/1967 Zandmer
3,430,711 A * 3/1969 Taggart ..... 175/4.52
3,924,677 A 12/1975 Prenner et al.
4,285,398 A 8/1981 Zandmer et al.
4,716,973 A 1/1988 Cobern
4,744,438 A 5/1988 Ruzie et al.
4,915,172 A 4/1990 Donovan et al.
5,130,705 A 7/1992 Allen et al.
5,165,478 A 11/1992 Wilson
5,186,255 A 2/1993 Corey
5,224,556 A 7/1993 Wilson et al.
5,228,518 A * 7/1993 Wilson et al. ..... 166/369

(Continued)

FOREIGN PATENT DOCUMENTS

EP 0433110 A1 11/1990

(Continued)

*Primary Examiner*—David J Bagnell
*Assistant Examiner*—James G Sayre
(74) *Attorney, Agent, or Firm*—Steve Rosenblatt

(57) ABSTRACT

An apparatus and method for perforating a liner, fracturing a formation, and injecting or producing fluid, all in one trip with a single tool. The tool has a plurality of outwardly telescoping elements(12,14) for perforation, fracturing. The tool also has a mechanical control device for selectively controlling the fracturing of the formation and the injection or production of fluids through the telescoping elements.

11 Claims, 3 Drawing Sheets

U.S. PATENT DOCUMENTS

| | | | | |
|---|---|---|---|---|
| 5,243,562 | A | 9/1993 | Laurent et al. | |
| 5,251,708 | A | 10/1993 | Perry et al. | |
| 5,379,838 | A | 1/1995 | Wilson et al. | |
| 5,829,520 | A | 11/1998 | Johnson | |
| 5,881,809 | A * | 3/1999 | Gillespie et al. | 166/233 |
| 6,601,646 | B2 * | 8/2003 | Streich et al. | 166/278 |
| 2003/0136562 | A1 * | 7/2003 | Robison et al. | 166/298 |

FOREIGN PATENT DOCUMENTS

| | | | |
|---|---|---|---|
| EP | 0533526 | A1 | 9/1992 |
| EP | 0774565 | A2 | 5/1997 |
| GB | 2185574 | A | 7/1987 |
| WO | WO 03/104611 | * | 12/2003 |

* cited by examiner

COMPLETION METHOD WITH TELESCOPING PERFORATION AND FRACTURING TOOL

CROSS REFERENCE TO RELATED APPLICATIONS

Not Applicable

STATEMENT REGARDING FEDERALLY SPONSORED RESEARCH OR DEVELOPMENT

Not Applicable

BACKGROUND OF THE INVENTION

1. Field of the Invention

The present invention is in the field of apparatus and methods used in fracturing an underground formation in an oil or gas well, and producing hydrocarbons from the well or injecting fluids into the well.

2. Background Art

In the drilling and completion of oil and gas wells, it is common to position a liner in the well bore, to perforate the liner at a desired depth, to fracture the formation at that depth, and to provide for the sand free production of hydrocarbons from the well or the injection of fluids into the well. These operations are typically performed in several steps, requiring multiple trips into and out of the well bore with the work string. Since rig time is expensive, it would be helpful to be able to perform all of these operations with a single tool, and on a single trip into the well bore.

BRIEF SUMMARY OF THE INVENTION

The present invention provides a tool and method for perforating a well bore liner, fracturing a formation, and producing or injecting fluids, all in a single trip. The apparatus includes a tubular tool body having a plurality of radially outwardly telescoping tubular elements, with a mechanical means for selectively controlling the hydrostatic fracturing of the formation through one or more of the telescoping elements and for selectively controlling the sand-free injection or production of fluids through one or more of the telescoping elements. The mechanical control device can be either one or more shifting sleeves, or one or more check valves.

One embodiment of the apparatus has a built-in sand control medium in one or more of the telescoping elements, to allow for injection or production, and a check valve in one or more of the telescoping elements, to allow for one way flow to hydrostatically fracture the formation without allowing sand intrusion after fracturing.

Another embodiment of the apparatus has a sleeve which shifts between a fracturing position and an injection/production position, to convert the tool between these two types of operation. The sleeve can shift longitudinally or it can rotate.

The sleeve can be a solid walled sleeve which shifts to selectively open and close the different telescoping elements, with some telescoping elements having a built-in sand control medium (which may be referred to in this case as "sand control elements") and other telescoping elements having no built-in sand control medium (which may be referred to in this case as "fracturing elements").

Or, the sleeve itself can be a sand control medium, such as a screen, which shifts to selectively convert the telescoping elements between the fracturing mode and the injection/production mode. In this embodiment, none of the telescoping elements would have a built-in sand control medium.

Or, the sleeve can have ports which are shifted to selectively open and close the different telescoping elements, with some telescoping elements having a built-in sand control medium (which may be referred to in this case as "sand control elements") and other telescoping elements having no built-in sand control medium (which may be referred to in this case as "fracturing elements"). In this embodiment, the sleeve shifts to selectively place the ports over either the "sand control elements" or the "fracturing elements".

Or, the sleeve can have ports, some of which contain a sand control medium (which may be referred to in this case as "sand control ports") and some of which do not (which may be referred to in this case as "fracturing ports"). In this embodiment, none of the telescoping elements would have a built-in sand control medium, and the sleeve shifts to selectively place either the "sand control ports" or the "fracturing ports" over the telescoping elements.

The novel features of this invention, as well as the invention itself, will be best understood from the attached drawings, taken along with the following description, in which similar reference characters refer to similar parts, and in which:

DETAILED DESCRIPTION OF THE INVENTION

Figure 1:
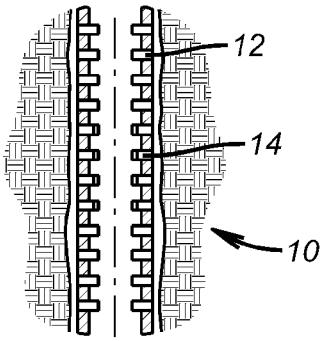
FIGS. 1 through 3 show an embodiment of the invention having a shifting sleeve, some sand control elements, and some fracturing elements, arranged to apply fracturing pressure both above and below a production or injection zone.
Figure 2:
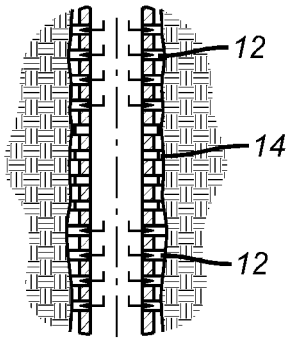
Figure 3:
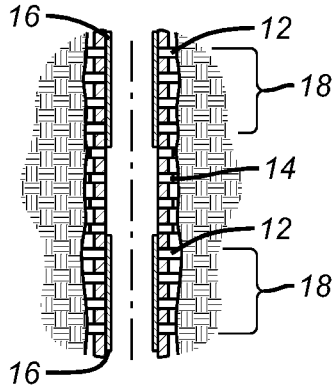

As shown in FIG. 1, in one embodiment, the tool 10 of the present invention has a plurality of telescoping elements 12, 14. All of these telescoping elements 12, 14 are shown retracted radially into the body of the tool 10, in the run-in position. A first group of these elements 12 have no sand control medium therein, while a second group of these elements 14 have a sand control medium incorporated therein. The sand control medium prevents intrusion of sand or other particulate matter from the formation into the tool body. FIG. 2 shows the telescoping elements 12, 14 extended radially outwardly from the body of the tool 10 to contact the underground formation, such as by the application of hydraulic pressure from the fluid flowing through the tool 10. If any of the elements 12, 14 fail to fully extend upon application of this hydraulic pressure, they can be mechanically extended by the passage of a tapered plug (not shown) through the body of the tool 10, as is known in the art. After extension of the telescoping elements 12, 14 to contact the formation, a proppant laden fluid is pumped through the tool 10, as is known in the art, to apply sufficient pressure to fracture the formation and to maintain the formation cracks open for the injection or production of fluids. This proppant laden fluid will pass through the fracturing elements 12, but it will not damage the sand control elements 14. After fracturing, a shifting sleeve 16 is shifted longitudinally, in a sliding fashion, as shown in FIG. 3, to cover the fracturing elements 12, while leaving the sand control elements 14 uncovered. Shifting of the sleeve 16 can be by means of any kind of shifting tool (not shown) known in the art. It can be seen that in this case, the fracturing elements 12 are arrayed in two fracturing zones 18, both above and below the desired production/injection zone where the sand control elements 14 are arrayed. When the upper and lower fracturing zones 18 are fractured, the formation cracks will propagate throughout the depth of the injection/production zone therebetween.

Figure 4:
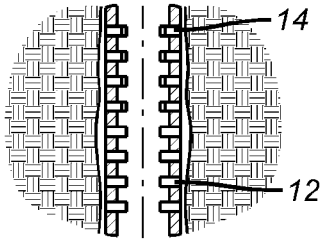
FIGS. 4 through 6 show an embodiment of the invention having a shifting sleeve, some sand control elements, and some fracturing elements, arranged to apply fracturing pressure only below a production or injection zone.
Figure 5:
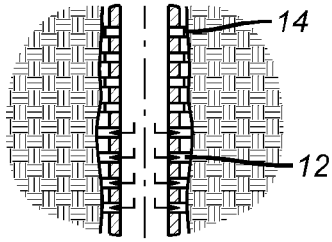
Figure 6:
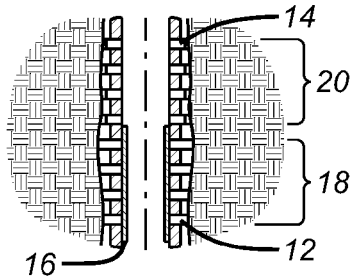

FIGS. 4 through 6 show a similar type of tool 10 to that shown in FIGS. 1 through 3, except that the fracturing zone 18 is only below the injection/production zone 20. This type of arrangement might be used where it is not desired to fracture a water bearing formation immediately above the injection/production zone 20.

Figure 7:
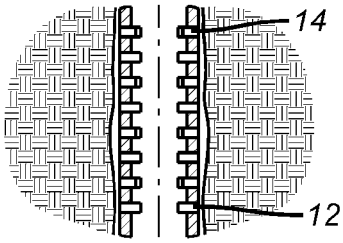
FIGS. 7 through 9 show an embodiment of the invention having no shifting sleeve, but with some sand control elements, and some fracturing elements having a mechanical check valve.
Figure 8:
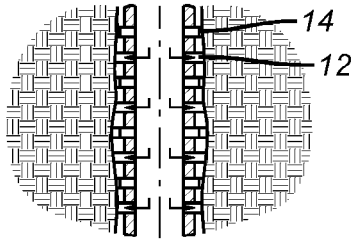
Figure 9:
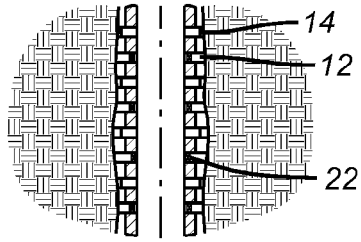

FIGS. 7 through 9 show another embodiment of the tool 10 which has no shifting sleeve. This embodiment, however, has a different type of mechanical control device for controlling the fracturing and production/injection through the telescoping elements 12, 14. That is, while as before, each of the sand control elements 14 incorporates a built-in sand control medium, each of the fracturing elements 12 incorporates a check valve 22 therein. So, in this embodiment, once the tool 10 is at the desired depth, and the telescoping elements 12, 14 have been extended, the fracturing fluid passes through the check valves in the fracturing elements 12 into the formation. Thereafter, the hydrocarbon fluids can be produced from the formation through the sand control elements 14, or fluid can be injected into the formation through the sand control elements 14.

It can be seen that in FIGS. 7 through 9, the fracturing elements 12 alternate both above and below the sand control elements 14, instead of being grouped above or below as shown in two different types of arrangement in FIGS. 1 through 6. It should be understood, however, that any of these three types of arrangement could be achieved with either the shifting sleeve type of tool or the check valve type of tool.

Figure 10:
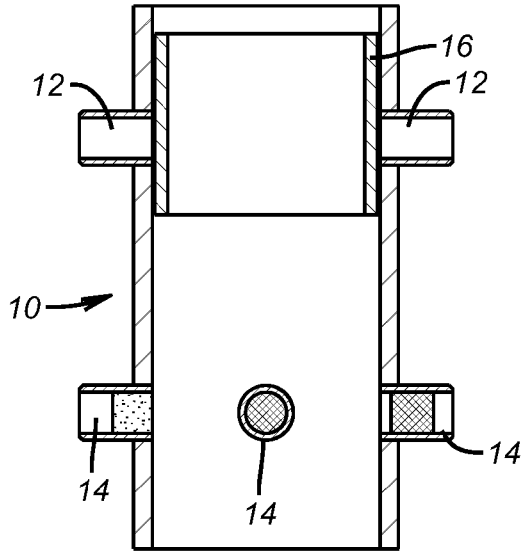
FIGS. 10 and 11 show an embodiment of the invention having a solid walled shifting sleeve, some sand control elements, and some fracturing elements.
Figure 11:
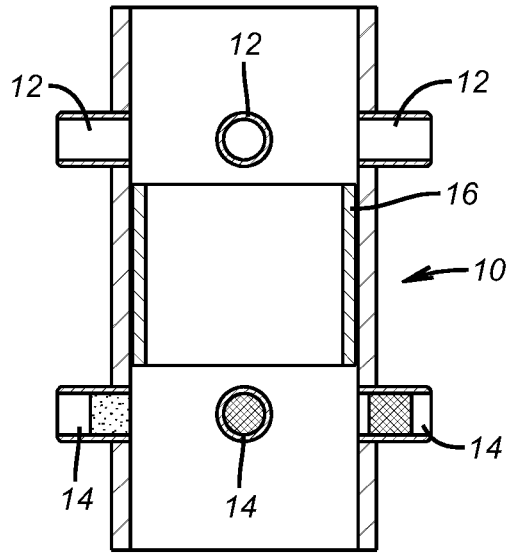

Other embodiments of the apparatus 10 can also be used to achieve any of the three types of arrangement of the telescoping elements 12, 14 shown in FIGS. 1 through 9. First, a longitudinally sliding type of shifting sleeve 16 is shown in FIGS. 10 and 11. In this embodiment, the shifting sleeve 16 is a solid walled sleeve as before, but it can be positioned and adapted to shift in front of, as in FIG. 10, or away from, as in FIG. 11, a single row of fracturing elements 12, as well as the multiple row coverage shown in FIG. 3. It can be seen that the fracturing elements 12 have an open central bore for the passage of proppant laden fracturing fluid. The sand control elements 14 can have any type of built-in sand control medium therein, with examples of metallic beads and screen material being shown in the Figures. Whether or not the shifting sleeve 16 covers the sand control elements 14 when it uncovers the fracturing elements 12 is immaterial to the efficacy of the tool 10.

Figure 12:
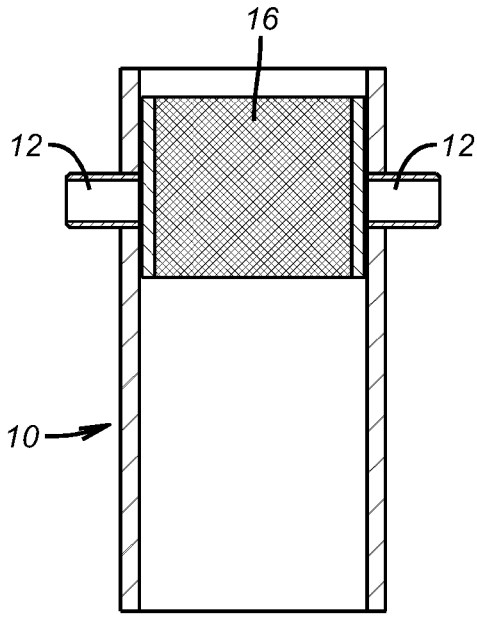
FIGS. 12 and 13 show an embodiment of the invention having a shifting sleeve incorporating a sand control medium, where none of the telescoping elements have a sand control medium.
Figure 13:
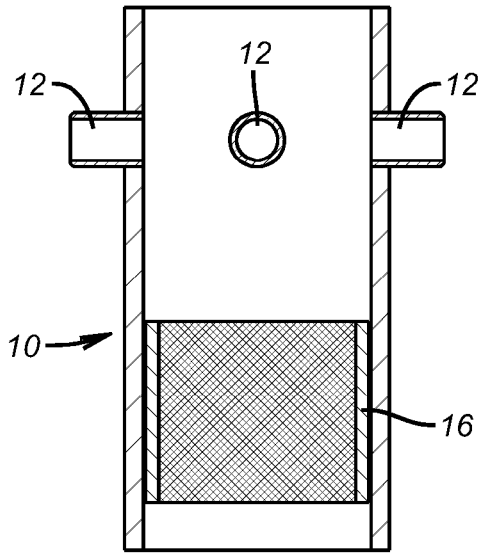

A second type of shifting sleeve 16 is shown in FIGS. 12 and 13. This longitudinally sliding shifting sleeve 16 is constructed principally of a sand control medium such as a screen. FIG. 12 shows the sleeve 16 positioned in front of the telescoping elements 12, for injection or production of fluid. FIG. 13 shows the sleeve 16 positioned away from the telescoping elements 12, for pumping of proppant laden fluid into the formation. In this embodiment, none of the telescoping elements has a built-in sand control medium.

Figure 14:
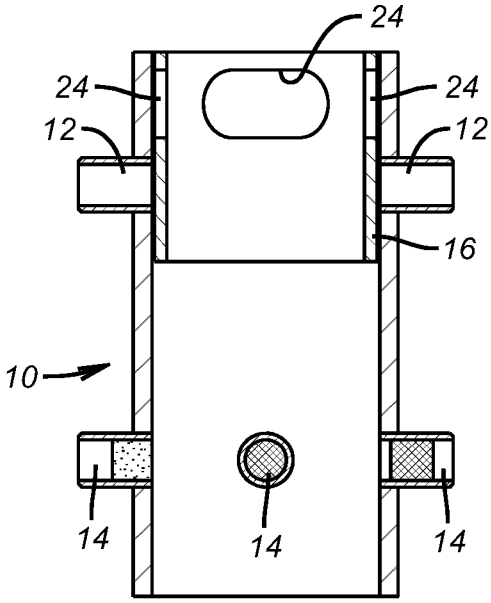
FIGS. 14 and 15 show an embodiment of the invention having a shifting sleeve with ports, some sand control elements, and some fracturing elements.
Figure 15:
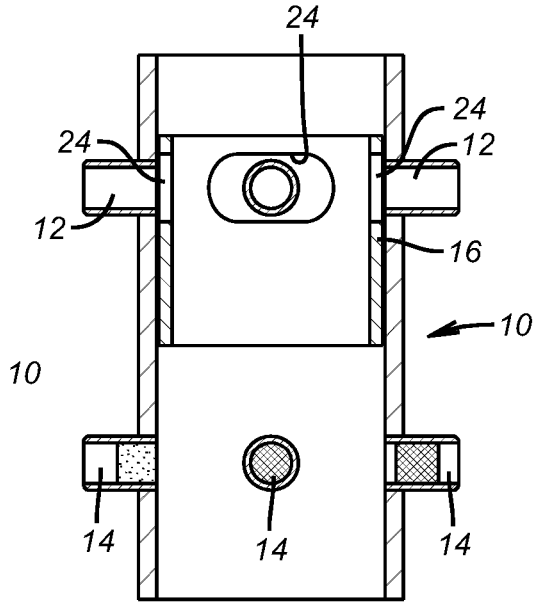

A third type of shifting sleeve 16 is shown in FIGS. 14 and 15. This shifting sleeve 16 is a longitudinally shifting solid walled sleeve having a plurality of ports 24. The sleeve 16 shifts longitudinally to position the ports 24 either in front of or away from the fracturing elements 12. FIG. 14 shows the ports 24 of the sleeve 16 positioned away from the fracturing elements 12, for injection or production of fluid through the sand control elements 14. FIG. 15 shows the ports 24 of the sleeve 16 positioned in front of the fracturing elements 12, for pumping of proppant laden fluid into the formation. In this embodiment, the fracturing elements 12 have an open central bore for the passage of proppant laden fracturing fluid. The sand control elements 14 can have any type of built-in sand control medium therein. Here again, whether or not the shifting sleeve 16 covers the sand control elements 14 when it uncovers the fracturing elements 12 is immaterial to the efficacy of the tool 10.

Figure 16:
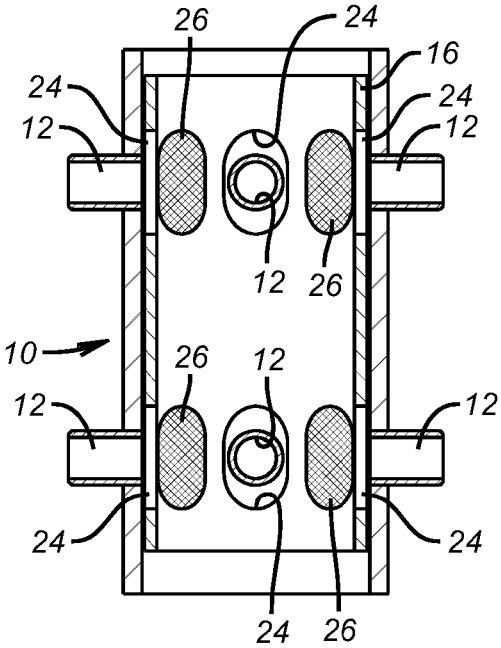
FIGS. 16 and 17 show an embodiment of the invention having a shifting sleeve with some sand control ports, and some fracturing ports.
Figure 17:
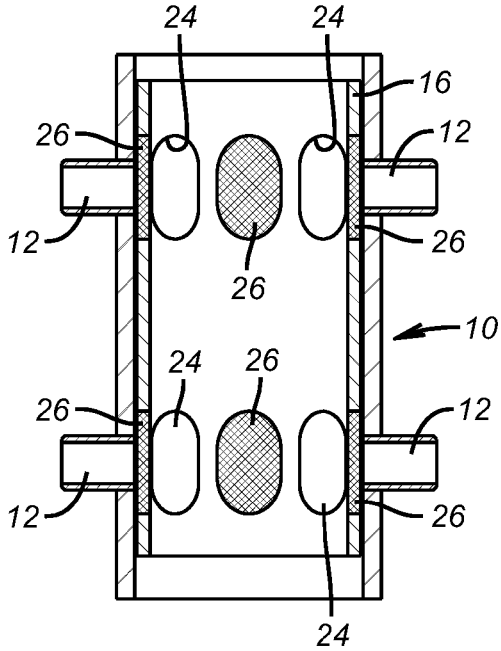

A fourth type of shifting sleeve 16 is shown in FIGS. 16 and 17. This shifting sleeve 16 is a rotationally shifting solid walled sleeve having a plurality of ports 24, 26. A first plurality of the ports 26 (the sand control ports) have a sand control medium incorporated therein, while a second plurality of ports 24 (the fracturing ports) have no sand control medium therein. The sleeve 16 shifts rotationally to position either the fracturing ports 24 or the sand control ports 26 in front of the telescoping elements 12. FIG. 16 shows the fracturing ports 24 of the sleeve 16 positioned in front of the elements 12, for pumping of proppant laden fluid into the formation. FIG. 17 shows the sand control ports 26 of the sleeve 16 positioned in front of the telescoping elements 12, for injection or production of fluid through the elements 12. In this embodiment, all of the telescoping elements 12 have an open central bore; none of the telescoping elements has a built-in sand control medium.

It should be understood that a rotationally shifting type of sleeve, as shown in FIGS. 16 and 17, could be used with only open ports, as shown in FIGS. 14 and 15, with both fracturing elements 12 and sand control elements 14, without departing from the present invention. It should be further understood that a longitudinally shifting type of sleeve, as shown in FIGS. 14 and 15, could be used with both open ports and sand control ports, as shown in FIGS. 16 and 17, with only open telescoping elements 12, without departing from the present invention.

While the particular invention as herein shown and disclosed in detail is fully capable of obtaining the objects and providing the advantages hereinbefore stated, it is to be understood that this disclosure is merely illustrative of the presently preferred embodiments of the invention and that no limitations are intended other than as described in the appended claims.

We claim:

1. A well completion method, comprising:

positioning a string downhole that has at least one extendable passage;

extending said passage downhole;

fracturing through said passage;

positioning a particulate control member, delivered with said string, in flow communication with said passage after said fracturing;

taking production through said extendable passage and said particulate control member.

2. The method of claim 1, comprising:

movably mounting said particulate control member within said string.

3. The method of claim 2, comprising:

sliding said particulate control member longitudinally into or out of alignment with said passage.

4. The method of claim 3, comprising:

shaping said particulate control member as a shifting cylindrically shaped screen within said string.

5. The method of claim 2, comprising:

rotatably mounting said particulate control member.

6. The method of claim 5, comprising:

providing a sleeve with at least one open port and at least one screened port;

selectively aligning said open port with said passage for fracturing and said screened port with said passage for taking production.

7. The method of claim 6, comprising:

providing a plurality of passages on said string;

selectively aligning said plurality of passages at the same time with said open port for fracturing and then said screened port for subsequent production.

8. A downhole completion apparatus, comprising:

a tubular string having at least one selectively extendable passage;

a screen, secured to said string before said string is run downhole and subsequently moved in said tubular for selective alignment and misalignment with said passage.

9. The apparatus of claim 8, wherein:

said screen comprises a cylindrical volume shiftable in said string for alignment and misalignment with said passage.

10. A completion apparatus, comprising:

a tubular string having at least one selectively extendable passage;

a screen movably mounted in said tubular for selective alignment and misalignment with said passage;

said screen comprises a tubular sleeve having at least one open port and at least one screened port, said sleeve movable to selectively align said open port with said passage for fracturing and said screened port with said passage for taking production.

11. The apparatus of claim 10, wherein:

said sleeve is movable longitudinally or rotationally on its axis within said string.

* * * * *

UNITED STATES PATENT AND TRADEMARK OFFICE

CERTIFICATE OF CORRECTION

PATENT NO. : 7,604,055 B2
APPLICATION NO. : 11/578023
DATED : October 20, 2009
INVENTOR(S) : Bennett M. Richard et al.

It is certified that error appears in the above-identified patent and that said Letters Patent is hereby corrected as shown below:

Cover page, item (75) Inventors, line 2, replace "Richard W." with --Yang--

Signed and Sealed this

Twenty-ninth Day of December, 2009

David J. Kappos

David J. Kappos
*Director of the United States Patent and Trademark Office*